US007336173B1

(12) United States Patent
Sandbrand

(10) Patent No.: US 7,336,173 B1
(45) Date of Patent: Feb. 26, 2008

(54) OWNER AWARE OBJECTS

(76) Inventor: Alexander Sandbrand, 39 Hughes Ter., Yonkers, NY (US) 10701

( * ) Notice: Subject to any disclaimer, the term of this patent is extended or adjusted under 35 U.S.C. 154(b) by 178 days.

(21) Appl. No.: 11/389,803

(22) Filed: Mar. 27, 2006

Related U.S. Application Data

(60) Provisional application No. 60/670,028, filed on Apr. 11, 2005.

(51) Int. Cl.
*G08B 13/14* (2006.01)

(52) U.S. Cl. ..... 340/568.1; 340/286.07; 340/572.1; 340/573.1

(58) Field of Classification Search ..... 340/568.1, 340/286.07, 572.1, 573.1, 572.3, 572.8, 572.9, 340/571
See application file for complete search history.

(56) References Cited

U.S. PATENT DOCUMENTS 5,635,897 A * 6/1997 Kuo ..... 340/7.58
6,297,737 B1 * 10/2001 Irvin ..... 340/571
2003/0034887 A1 * 2/2003 Crabtree et al. ..... 340/539
2003/0122673 A1 * 7/2003 Anderson ..... 340/568.7
2006/0058018 A1 * 3/2006 Toulis et al. ..... 455/422.1
2007/0075919 A1 * 4/2007 Breed ..... 345/8

* cited by examiner

*Primary Examiner*—Brent A. Swarthout

(57) ABSTRACT

The Owner Aware Object represents a new class of Physical Objects that mimic the awareness of the presence or absence in their immediate surroundings of their rightful owner. The system is composed of an Owner Private Space Generator, one or multiple Owner Private Space Sensors and an optional Super Owner Aware Object which is a Computer connected Owner Aware Object. The Generator and the Sensor Objects work together to establish within a three dimensional space, a volume of Object and Owner Security. While within this volume, the Sensor is maintaining ciphered communication link with the Generator and thus establishes a Secure Volume. Should these two components lose this link, a breach of security event is triggered and both units attempt Owner Notification of the new state of the system. Should two or more Owner Private Spaces intersect or collide, all Owners are notified of the new system status.

11 Claims, 10 Drawing Sheets

Replacement Sheet

SECTION A-A

OWNER AWARE OBJECTS

This application claims the benefit of my provisional application U.S. 60/670,028 of Apr. 11, 2005

FIELD OF THE INVENTION

This invention creates a new Consumer Product which relates to Personal Object Security. It provides a means of relaxing the owner continuous supervision of his possessions by automating the process. The owner is alerted only when a breach of his security occurs. While Personal Object Supervision is the main trust of this invention, it is also related to Paging, Voice Messaging, Key Less Entry, Medical Tagging and RFID fields.

DESCRIPTION OF THE RELATED ART

There are many instances when valuable objects must remain in the immediate presence of the owner and to this end, many solutions have been devised.

The so called "Finder" solutions are based on the idea that a Radio Frequency signal broadcasted from a control unit will trigger an audible alarm and thus revealing the position of the lost or hidden object.

Some loss prevention solutions are based on the continuous communications between a monitor and a tag, solution that requires two different hardware and/or software architectures, one for the monitor and one for the tag.

Most of the previous Related Art refers to a bulky and power hungry monitor that is not portable and it is very obtrusive.

For example, U.S. Patent No. 2003/0034887 published in Feb. 2, 2003 discloses an object finder composed of a tracking Radio Transceiver and a bulky hand held locator. The locator broadcast a Radio Frequency signal that is received by the tracking transceiver attached to the object which will activate it's audible alarm.

The WO-00/19390 describes a golf club and a divot tool set used to remind the golfer that he has forgotten his club.

D. Irvin in U.S. Pat. No. 6,297,737 of Oct. 21, 2001 describes a Radio Frequency locating system that is based oh a command scheme in which an alarm is affixed to the object and it is activated at a command from the remote transmitter.

The U.S. Pat. No. 5,635,897 describes a cellular phone to which a periodic transmitter has been affixed to it. The user is wearing a receiver which will actuate its alarm should it not receive the transmitter signal anymore While all previously patents provide a means to deter theft or to find a lost object they all have substantial shortcomings in their operationally, user interface, form factor and footprint, and power source life expectancy. Some patents are even unrealizable under their presented form factors. The Owner Aware Object Invention addresses and solves all these problems.

SUMMARY OF THE INVENTION

This invention is pertinent to the Owner Private Space and the Owner Aware Objects. The Owner Private Space is considered an all encompassing, secure and private space around the owner and which can not be intruded. Owner Aware Objects are any physical objects that through the enabling of this invention will be aware of the presence or absence of its Owner Private Space and will act accordingly. This is accomplished by a process of self learning in which the Objects are learning from each other of their intended Scope and Identification. The Owner Private Space is generated by an Electromagnetic Generator that creates a Three Dimensional Electromagnetic Field around the Owner. An Owner Aware Object can be either a Generator or a Private Space Sensor. There is no physical or functional distinction between these two. Both functions are incorporated in the same enclosure. Any Owner Aware Object, either the Private Space Generator or the Private Space Sensor, can be affixed to any physical object and thus conveying to it all the properties of an Owner Aware Object The Owner Private Space is mobile/portable and it will change its geographical position with the Owner.

Due to the very low power consumption there is no power switch. The units exit the manufacturing plant powered but in a deep sleep state. The user needs to push a button on one of his Owner Aware Objects which will wake up all similar Owner Aware Objects from within the Owner Private Space. Once up, the Objects start a private and Encrypted Communication Protocol. At the end of this procedure, every unit is assigned automatically an Identification Code and a Scope.

The Scope can be either of a Private Space Generator, a Private Space Sensor or both. An Owner Aware Object can operate in both modes at once. It can be a Space Generator and in the same time a Space Sensor. This permits the total volume of the Owner Aware Owner Private Space to grow incrementally with every unit without the need to increase the RF power output or the receiver sensitivity. For example, referring to FIG. 3, if Owner Aware Object "A" is the Owner Private Space Generator and Owner Aware Object "D" is a Owner Private Space Sensor, then if Owner Aware Object "E" is an Orphan i.e. outside of the sphere of influence of Owner Aware Object "A" but it can get in contact with Owner Aware Object "D", which is a Owner Aware Object Private Space Sensor, then Owner Aware Object "D" automatically starts relaying messages from Owner Aware Object "A" to Owner Aware Object "E" and vice versa, effectively doubling the initial range of the Owner Aware Object Private Space Generator "A". It is said then that the Owner Aware Object "D" is operating in Mixed Mode. There are no restrictions in how many Objects operate in Mixed Mode.

Owner Aware Objects can announce an Owner Aware Object Private Space violation in four ways.

First, every Owner Aware Object has an Acoustical Enunciator. Because this is a linear device it can be used to convey voice messages thus mimicking a Voice Pager. The Voice Messages are sent by the Super Owner Aware Object. Super Owner Aware Objects are these Owner Aware Objects connected to a Computer. The Super Owner Aware Object can be used to Voice and Tone Page individual Objects, to send Morse Code Text, or to upload the Object Event Log.

The Acoustical Enunciator is housed in a special Acoustical Chamber 7001, that mechanically amplifies the sound of the Transducer. Referring to FIG. 7 and FIG. 7B the form and mounting position of the Acoustical Transducer 7004 are critical for the operation of the Owner Aware Object and thus are object of one of this invention Claims. The Acoustical Transducer 7004 is mounted on the side of the 7006 Top Edge such that it will protrude outside of the printed circuit board enclosure volume. It can be seen that this protrusion creates a cylindrical chamber 7001 that terminates in a slightly conical focusing and perforated dome 7003. Behind the cylindrical chamber is an elongated conical section 7002 and 7000 that is tuned to the specific mechanical resonance of a certain acoustical frequency range. The position of the protrusion on the 7006 Top Edge of the housing allows the Acoustical Port of the 7001 Acoustical Chamber to remain unobstructed even the Owner Aware Object is compressed in a small wallet.

The Acoustical Enunciator emits a different Beep and/or Trill for every Intrusion or Messaging Event thus making the Event recognizable just by its type of Acoustical Alarm.

The Acoustical Enunciator Alarm Subsystem has digital, compressed and locally stored short Alarm Voice Messages such as "ALARM', "INTRUDER", "THIEF", "STOLEN", "MESSAGE WAITING" and so on. These Voice Alarm Messages are stored in multiple foreign Languages. The User preferred Language can be set and modified by the Super Owner Aware Object. The Voice Alarm Messages can be used in conjunction or in place of the regular Beeps and/or Trills. New Voice Alarm Messages can be downloaded from the Super Owner Aware Object.

Second there is a Light Emitting Diode that functions as a Visual Enunciator. The Light Emitting Diode Enunciator has a different cadence/rate of ON/OFF states for every Intrusion and/or Messaging Event and for every Communication Channel.

Third, a small electrical motor with a small eccentric flywheel mounted on its shaft, provides the tactile sensation of vibration. The Electrical Motor of the Enunciator has a different ON/OFF cadence/rate of states for every Intrusion and/or Messaging Event and for every Communication Channel, thus giving different tactile sensations for different Intrusion/Messaging Events to the User.

And fourth, a small holding cylinder 8001 containing an amount of highly repulsive smelling gas under pressure functions as an Olfactive Enunciator. A small amount of badly smelling gas is released through the opening of the release tube 8002 of an Electromagnetic Valve 8001 when the Owner Personal Space is Intruded. The badly smelling Gas can be replaced by a Perfume under pressure. The cylinder can be filled with a mixture of high pressure Gas and permanent ink which will allow marking with a specific signature the place where the Owner Aware Object has been.

The Objects can be powered in three modes.

First is the regular Coin Cell Battery. The regular batteries provide enough power for years of continuous operation.

The second uses rechargeable batteries that are recharged from a Photovoltaic element affixed to the bottom of the enclosure.

The third mode uses a Contact-less Recharger constructed under the form of a small, low height plate, with a proximity sensor under the top surface. Normal state of the recharger is OFF. Once an Owner Aware Object is placed on it, the proximity sensor turns on the Recharger which starts to generate a high intensity, very low frequency Electromagnetic Wave. This Wave is captured by the inductor build into the Owner Aware Object; rectify it and the resulting Direct Current Voltage is used to recharge the batteries.

Because of the design simplicity, the basic functionality of the Owner Aware Object can be implemented in hardware with several gates. For a more flexible unit a Microprocessor can be used. This invention describes the Microprocessor version It is an object of this invention to provide an Owner Private Three Dimensional Space, that is Secure and Supervised;

It is an other object of this invention to provide an Owner Aware Object Generator that creates a Three Dimensional Secure and Supervised Space;

It is an other object of this invention to provide an Owner Aware Object Private Space Sensor that mimics the awareness of the presence or absence of its rightful owner;

It is an other object of this invention to provide both functions, this of an Owner Aware Object Private Space Generator and that of the Owner Aware Object Private Space Sensor in one single physical Object/Enclosure;

It is yet an other object of this invention to provide a ciphered and secure data link between the Owner Aware Object Private Space Generators and the Owner Aware Object Private Space Sensors;

It is yet an other object of this invention to provide on Owner Aware Object that has a communication range depending solely on their ability to exchange messages and not the distance between them as in any previous art work. The difference is that the ability to exchange messages does not depend on output power or receiver sensitivity but it depends of the propagation conditions, intervening obstacles, fading, jamming and collisions. In other words the ability to make contact of the Objects depends on the environment in which they are placed and their number within a particular volume or space, and it does not depend only of their physical and/or electrical proprieties such transmitter RF power output and receiver sensitivity;

It is yet an other object of this invention to provide the means of functional coexistence of many clusters of Owner Aware Object Private Space Generators within a small volume of space such a room, a bus, a concert hall and so on;

It is an other object of this invention that both Objects, the Owner Aware Object Private Space Generator and as well the Owner Aware Object Private Space Sensor to activate a multiple sensorial ALARM should they lose their periodic communication Link for any reason;

It is an other object of this invention that the Owner Aware Objects to be able to determine automatically their own identities within their Networks;

It is an other object of this invention that the Owner Aware Objects IDs be deleted automatically, from the Owner Aware Object Network, should they lose their secure communication link for any reason and/or physically and/or logically disappear from the network;

It is an other object of this Invention to increase the operating rage of the individual Owner aware object without increasing the Radio Frequency output power of the transmitter nor by increasing the Receiver sensitivity but by using the Mixed Mode of operations which allow the Owner Aware Objects to relay Network messages beyond the physical range of the Owner Aware Private Space Generator;

It is an other object of this invention to create the physical Owner Aware Object as Consumer Products and not as an Industrial or Laboratory piece of equipment;

It is an other object of this invention to add Tone Paging and Morse Code receiving and transmitting functionality to said Owner Aware Object;

It is an other object of this invention to add Voice Messaging and Paging capacities to the Object through an Acoustical Transducer 7004 mounted in a special position and in a mechanically enhanced Acoustical Chamber 7001 equipped with a specially engineered Sound Port 7003. Referring to the FIG. 4 the special position of the Acoustical Transducer is on the edge of the Printed Circuit Board and protruding outside and laterally of it in such a way that the enclosure's 7003 Forward Tuned Dome of FIG. 7A constructed in front of it can not be obstructed by near by objects or by somebody's finger and thus providing a clear path for Acoustical Transducer Sound Waves to propagate Referring to FIG. 7A it can be observed that the 7001 Acoustical Transducer Chamber is located within the protrusion on the 7006 Top Edge of the Housing it is yet an other object of this invention to provide Owner Aware Objects with canned Voice Messages that can be used as ALARM or Enunciator Messages;

It is an other object of this invention to provide all Voice Messages of the Owner Aware Objects, in multiple Languages such, English, French, German, Spanish, Russian and many more;

It is an other object of this invention to provide an Owner Aware Object which has an Olfactive type of Alarm which will release from a pressurized container, when necessary, a small amount of badly smelling Gas or a Perfume;

It is an other object of this invention to provide Alarm capabilities for both units, the Owner Aware Space Generator and as well to the Owner Aware Private Space Detector;

It is an other object of this invention to provide an extreme small form factor the Owner Aware Object. Because of the High Integration of the components used and their very low power consumption, the Active Owner Aware Object can be smaller than a Credit Card although a bit thicker;

It is an other object of this invention to provide improved elements and arrangements of thereof for the purpose of creating a significant functionality enhancement and a lower cost than any of the previous Art Work.

DETAILED DESCRIPTIONS OF THE PREFERRED EMBODIMENTS

FIG. 3 depicts one of the many self configuring networks that a multitude of Owner Aware Objects can realize. An "Any to Any" network is possible as every Owner Aware Object has Time Division Multiplex as well as Frequency Division Multiplex capability. All Objects are Time and Frequency agile ant thus able to avoid collisions, interference or jamming in software.

As FIG. 2. shows that the Owner Aware Objects have only two Integrated Circuits, the Radio Transceiver 17 and the Microprocessor 10. The Microprocessor holds the Program Memory 14 from where all instructions are executed. The Owner Aware Object minimum system is comprised of only two Owner Aware Objects, one taking the role of an Owner Private Space Generator 3011, the other becoming the Owner Private Space Sensor 3005. Multiple Owner Aware Private Space Sensors can be added directly to a single Owner Private Space Generator. If more are necessary, any or all of the Owner Aware Objects can switch to the Mixed Mode and relay the messages. One example is provided by Owner Aware Object 3005 which operates in Mixed Mode relaying messages from Owner Aware Object 3007 to Owner Aware Object 3011. The Owner Aware Objects have multiple Time and Frequency Division Communication Channels. A Communication Channel is composed of one Time Slot in the Time Division Multiplex Frame and one Private Radio Frequency. One of Communication Channels is designated as a "Rendezvous Channel" (RC) 3006 and is kept clear at all times. It is used only during network configuration or when an Owner Aware Object looses contact with its partner(s).

The Network of Owner Aware Objects is Self Configuring and Self Healing. The network operation and configuration resembles a Token Ring Network that has being modified to accommodate the specific Owner Aware Objects requirements. The major modification is that all nodes before relinquishing the Token transmit also a message to a specific node, the Owner Private Space Generator with the intent to reset its Alarm Timer. Should the Network Time Out the Token due a node not receiving this specific message in time and for any reason, the Owner Aware Private Space Generator Alarm Timer will timeout and thus it will activate its Alarms.

Referring to FIGS. 3, 5A and 5B, all Owner Aware Objects, after powering up 5001, a Hardware Initialization Routine 5002 is executed and set their Radio Transceivers to the Rendezvous Channel, 3006. The Owner Aware Objects then enter a Deep Sleep Mode 5003 waiting for the user to press a button on their Keyboard 28.

When the button is pressed on the Owner Aware Object 301 of FIG. 3, for example, it exits the Deep Sleep Mode 5004, sets the physical Address of the Owner Aware Object and the Network ID to ZERO, a random number is generated by the radio transceiver and used to compute the Logical Object Address 5005. Owner Aware Object 3011 sets its Scope to Space Generator and transmits a Network Configuration Command message to Owner Aware Object with Physical Address 1, Network ID ZERO 5007.

This transmission wakes up all Owner Aware Objects from within the Owner Aware Object 3011 physical range 3004. All Owner Aware Objects now generate a random number that is used to start a Time out Timer 6004. The Owner Aware Object that had the smallest random number loaded in the Timer, 3005 for example, will time out first. It will use the Physical Address received in the message at step 6011, check it for the maximum allowed Owner Aware Objects and if lower it will set its Physical address to it. A Logical Address is computed and set while the Network ID is copied from the message. The Scope of this Owner Aware Object is set to Space Sensor and the Owner Aware Object enters SLEEP state again in step 6015. All other Owner Aware Objects, because they were not addressed directly and their timers did not expire yet, have stopped their timers and went back to SLEEP. Should any communication errors intervene, the Network Link is checked for Jamming, Collision and Interference in steps 5011, 5012, 6006, 6007 and any of these condition is detected a Corrective Action is implemented in steps 5021 and 6009. The Owner Aware Object then enters the SLEEP mode again. Should the Corrective Action be unsuccessful or a Time Out Timer expire an Alarm Event is triggered. The particular Channel Alarm Parameters are loaded into the Alarm Processor 5037 and 6016 and the Alarm is activated.

This cycle is repeated until all Owner Aware Objects are initialized with their Physical and Logical Address as well their Scope. The last Owner Aware Object will transmit its Network Configuration Command END to the Space Generator Object which signals the conclusion of the Network Configuration Procedure.

All Objects, after they have terminated their local Network Configuration Routine, will switch from the Rendezvous Channel to the newly designated channels and enter the SLEEP state such in step 5018 and 6013. At this stage the network is fully configured. During this configuration all Owner Aware Objects have been assigned an several operation frequencies and several time slots and thus they will be able to avoid collisions with each other. Moreover a message directed to a particular Object will not wake up all other Objects as it is transmitted on a private frequency owned by exactly one Owner Aware Object. During the Network Configuration every Owner Aware Object discovered its uplink and downlink neighbor Address/ID so it knows were to expect messages from and where to send them. Also every Owner Aware Object has saved the Owner Aware Object Space Generator Address/ID so it can address it directly if needed.

To avoid collision the Network has a simple rule. An Owner Aware Object can not transmit until it is addressed. This simple rule provides order and makes the Network operations highly deterministic.

The normal run of the network is started by the Owner Aware Object Private Space Generator by sending a message to its uplink neighbor Owner Aware Object Private Space Sensor 1, step 5021. If Owner Aware Object Private Space Sensor 1 has a message for any other Owner Aware Object in the Network it will address it directly now and will transmit the message to it. The receiving Owner Aware Object replies with an acknowledge message at which Owner Aware Object Private Space Sensor 1 sends an ResetTimer message to the Owner Aware Object Private Space Generator as in step 5032. Owner Aware Object Private Space Sensor 1 addresses now its uplink neighbor Owner Aware Object Private Space Sensor 2 as in step 6013 giving it the right to use the Network and then going to SLEEP. Should the Owner Aware Object Private Space Generator not receive the ResetTimer message in time or if Owner Aware Object Private Space Sensor 1 does not receive the initial message in time both Objects will activate their Alarms according to their Alarm Specification Table. Owner Aware Object Private Space Sensor 2 and Owner Aware Object Private Space Sensor 3 now repeat the same procedure. Every time an Owner Aware Object is relinquishing the Network usage it transmits a ResetTimer message to the Owner Aware Object Space Generator which resets its Alarm Timer. The Owner Aware Object "n" then passes the Network Operations to its uplink neighbor.

If an Owner Aware Object is not responding to the Downlink Neighbor for "n" consecutive times, the network enters the reconfiguration mode during which the non-responsive Owner Aware Object is dropped from the Network automatically. When this happens, the Owner Aware Object Private Space Generator as well the Owner Aware Object that has been dropped from the network will activate their Alarms.

Every Owner Aware Object can receive and sound Voice Messages from the Super Owner Aware Object 3012. This can be any Owner Aware Object or a special Radio Transmitter connected to a Computer 3010 equipped with sound facilities. A microphone attached to the Computer 3010 enters the Analog voice message which is digitized and compressed, then sent through the Owner Aware Object network. The addressed Object will store the message locally and will activate the Acoustical Alarm with a specific Alarm. The User can now press the designated button which will playback the Voice Message on the Acoustical Transducer. Every short press on this button will replay the entire message. A long press on the same button will erase the message.

Paging can be done by Tone also. There are a multitude of different Paging Tone and Trills that can be associated mentally with certain Phone or Extension Numbers or the request for a specific User action. Any Owner Aware Object can transmit a Tone Page to any other Owner Aware Object.

All Objects can receive Morse Code from the Super Owner Aware Object. Clear Text entered on the Computer Keyboard is locally converted to a proprietary format message that then is transmitted as a broadcast to all Objects or directed to a specific one which will activate its Acoustical Transducer in the correct cadence specified by the Morse Code Protocol. Morse code elements characteristics are included in the message so the play back of the symbols can be tailored according to every individual user preferences. All Objects can transmit and receive multiple canned Morse Code Messages such as SOS, HELP, WAIT, STOP, etc. One of the Serial Port connector's pins is doubling as a Morse Code Manipulator entry Port. Attaching to it a Morse Code Manipulator allows sending Morse code directly.

Figure 1:
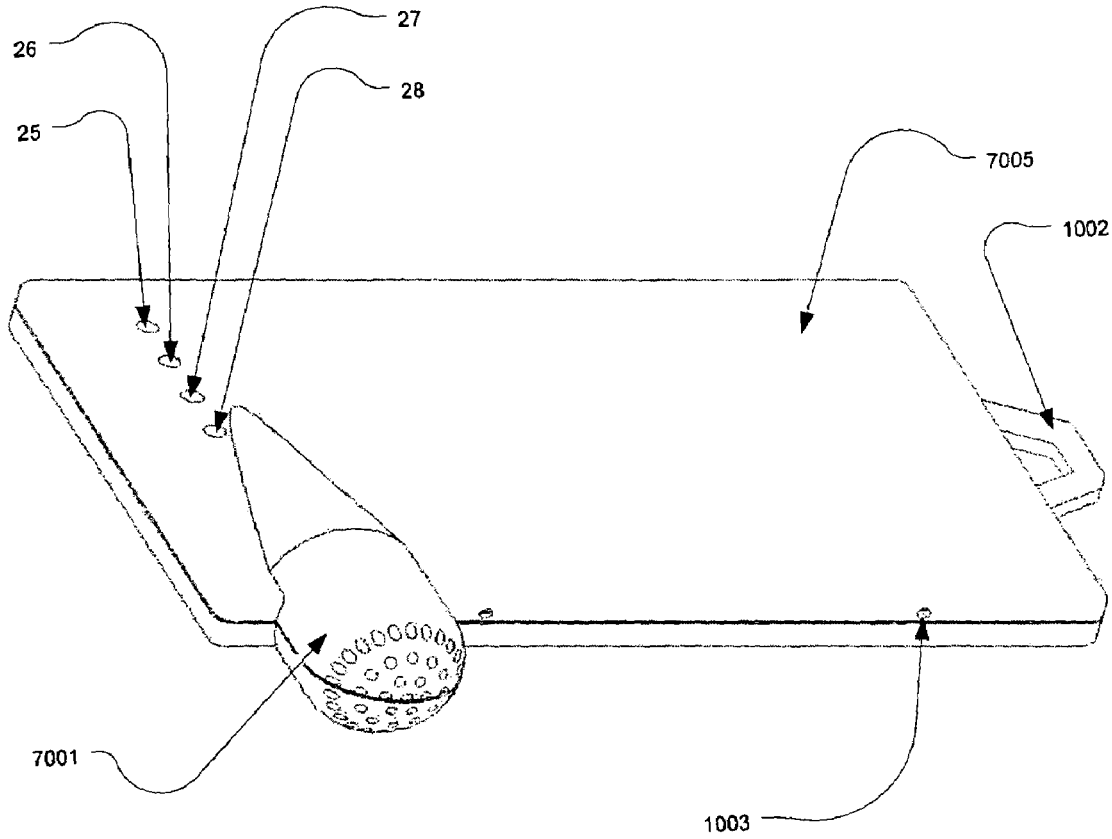
FIG. 1 is a perspective view of an Owner Aware Object according to the present invention.
Figure 2:
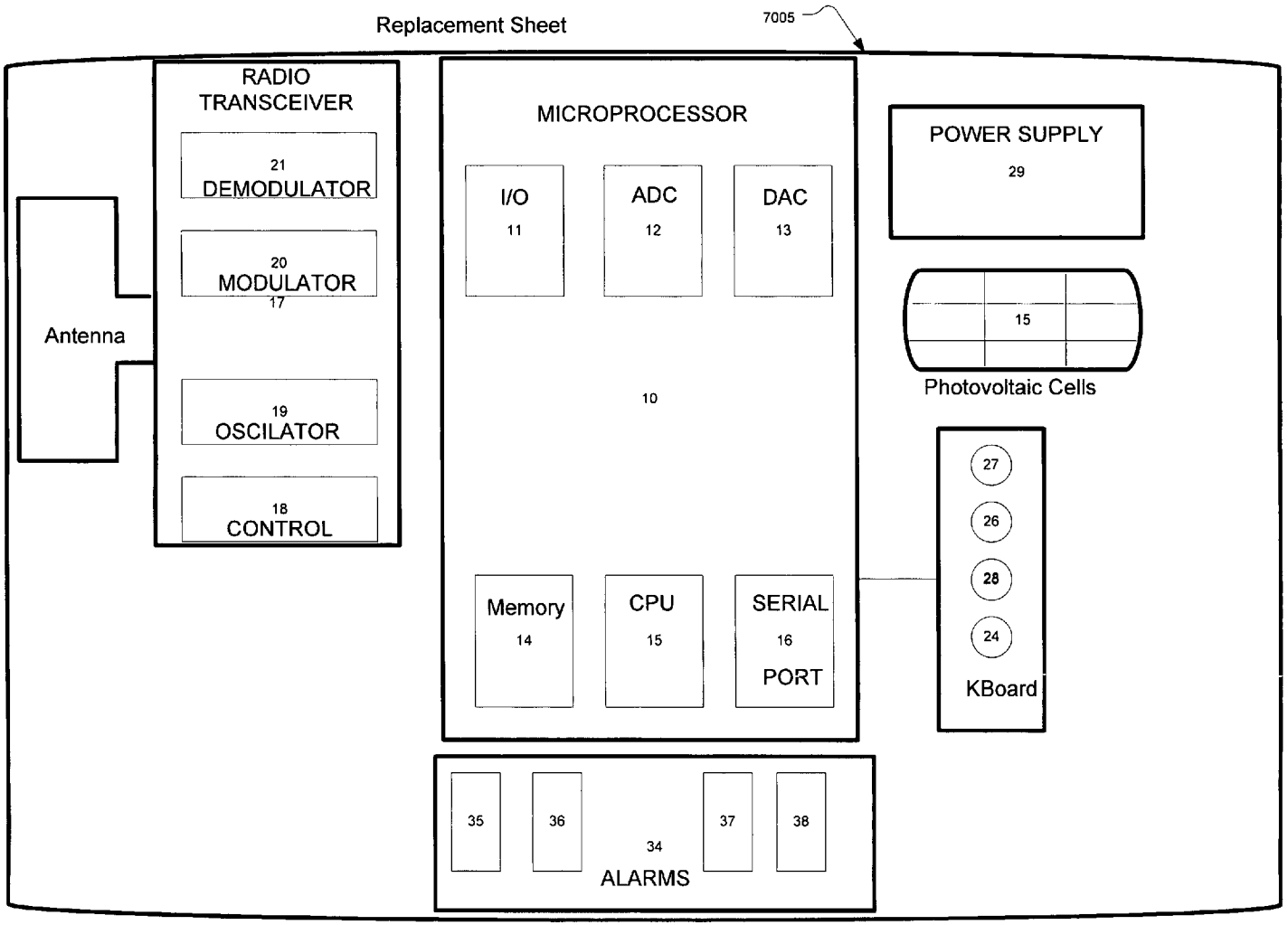
FIG. 2 is a diagrammatic view of an Owner Aware Object according to the present invention.
Figure 3:
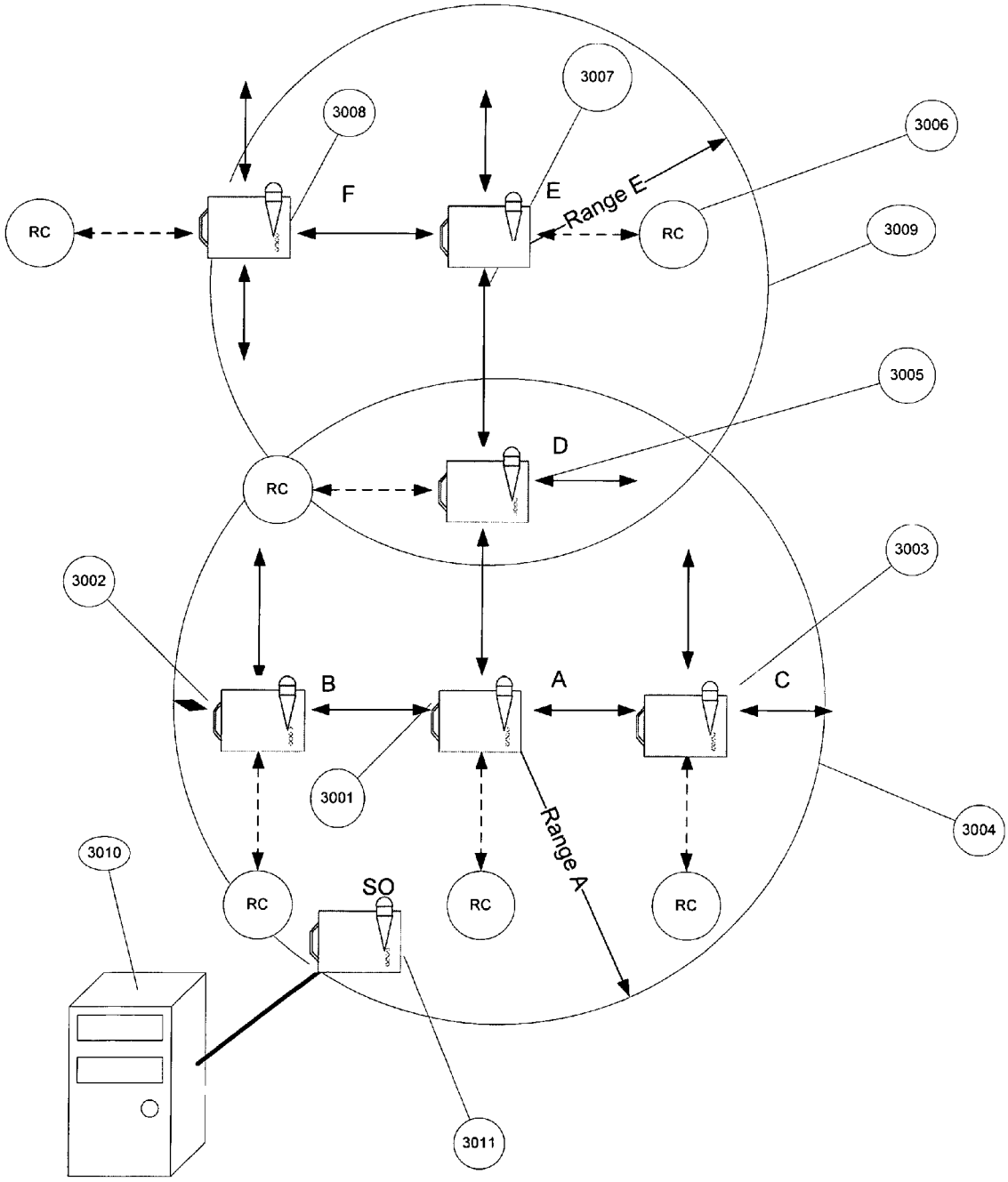
FIG. 3 represents one of the many adhoc self configuring wireless networks that the Owner Aware Objects can form. Specifically it shows the radio relay capabilities of node 3005.
Figure 4:
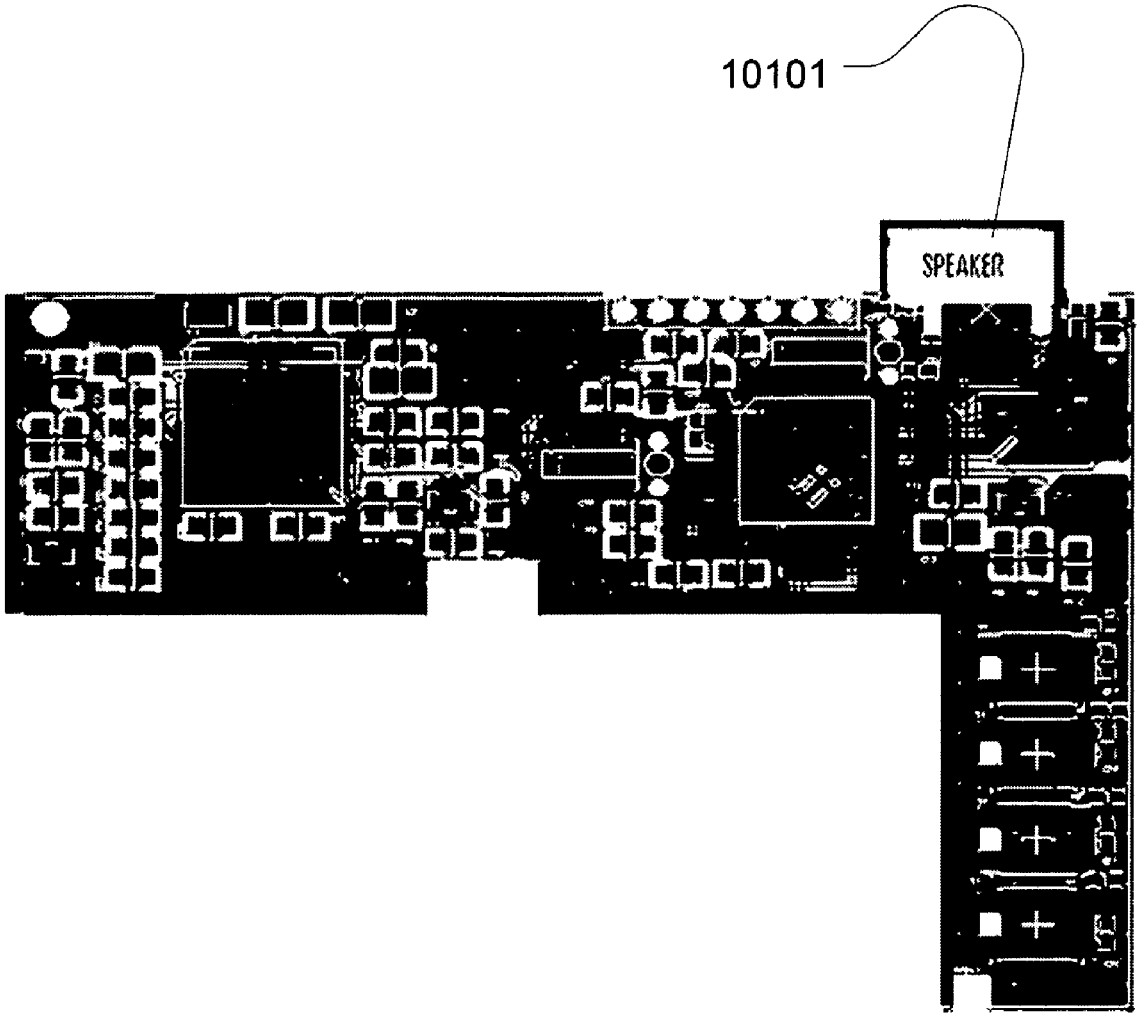
FIG. 4 depicts the special positioning/mounting of the speaker/acoustical transducer on the Printed Circuit Board.
Figure 5A:
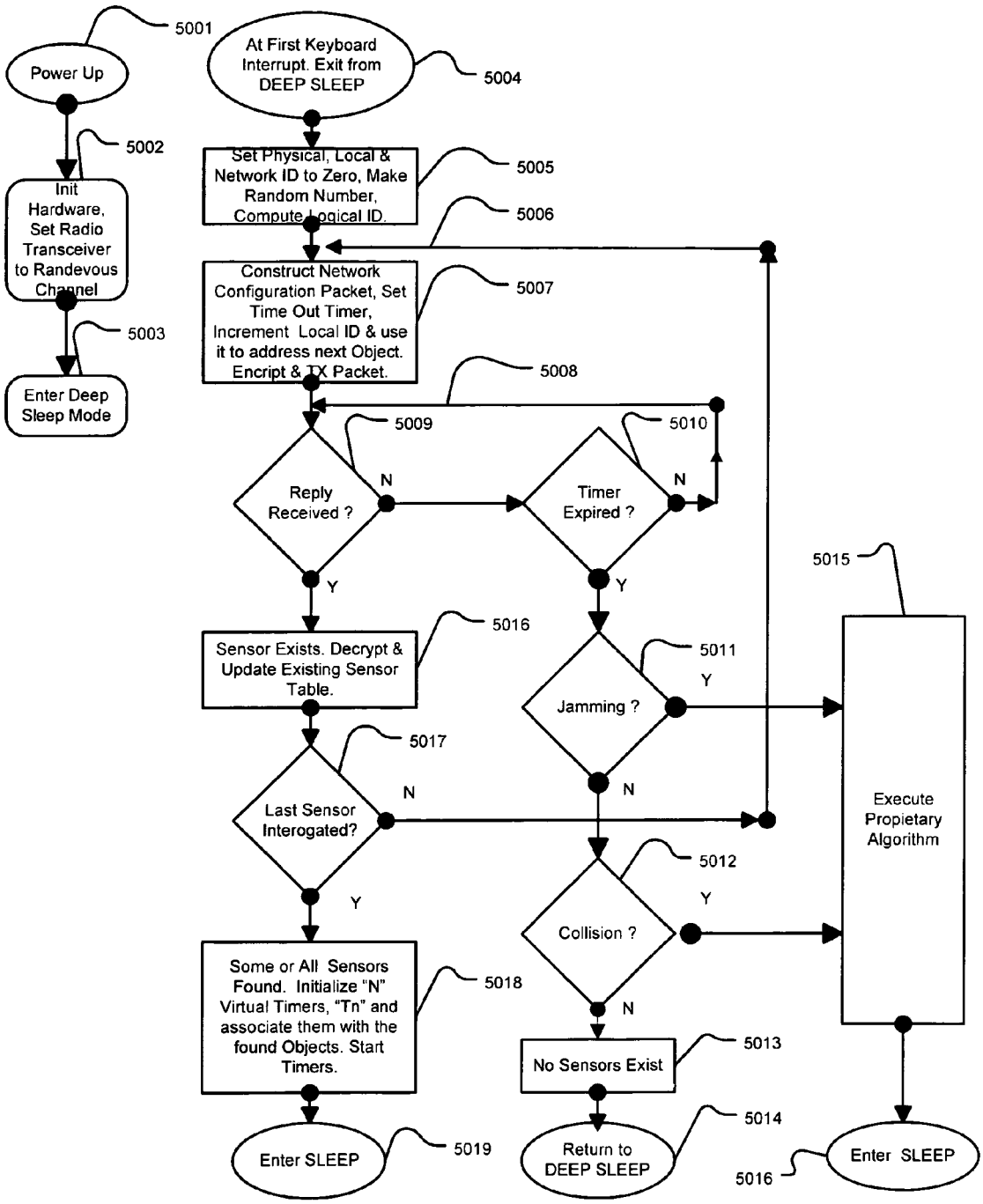
FIG. 5A is the Owner Aware Object Space Generator Firmware Flow Chart
Figure 5B:
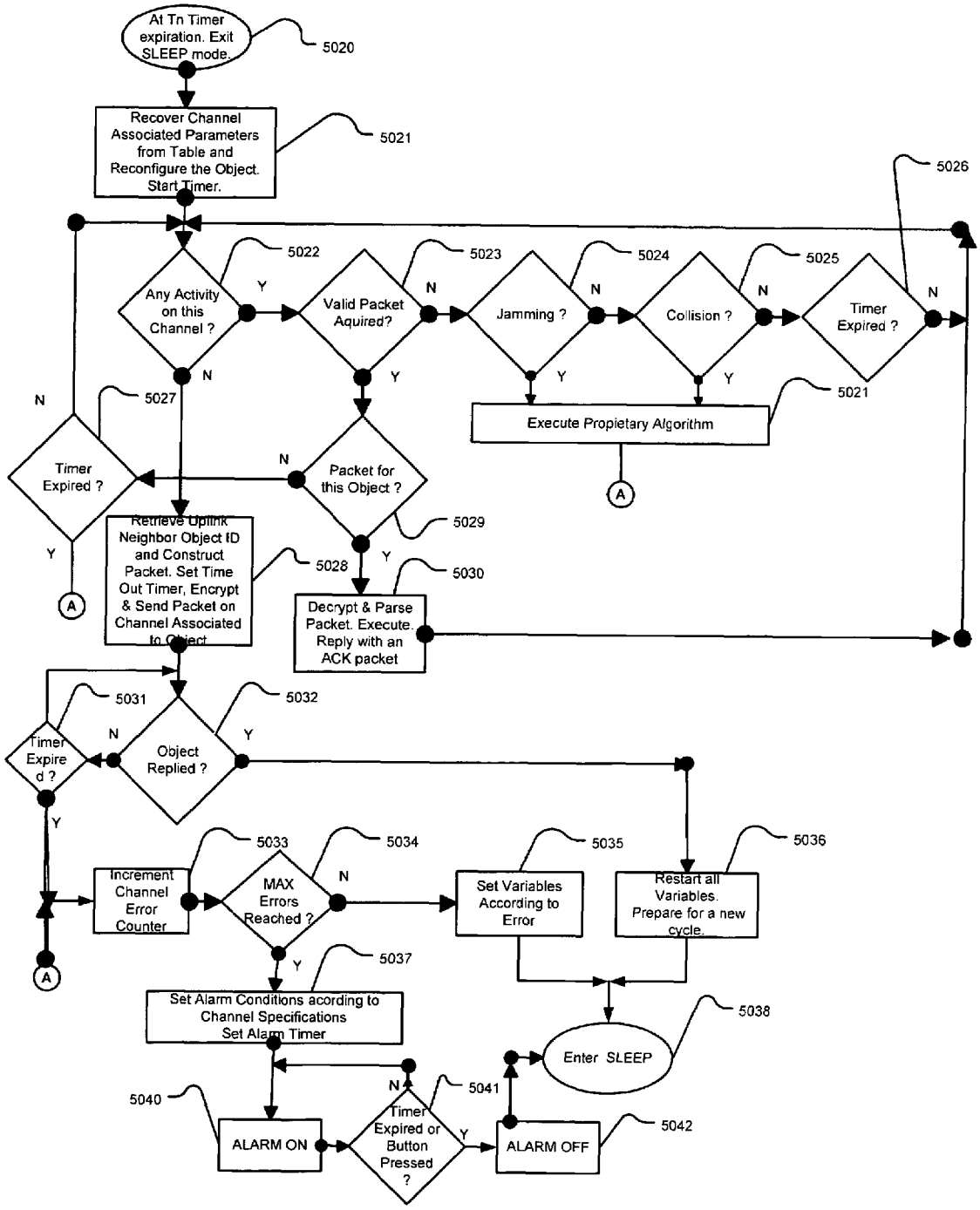
FIG. 5B is a continuation of the FIG. 5A.
Figure 6:
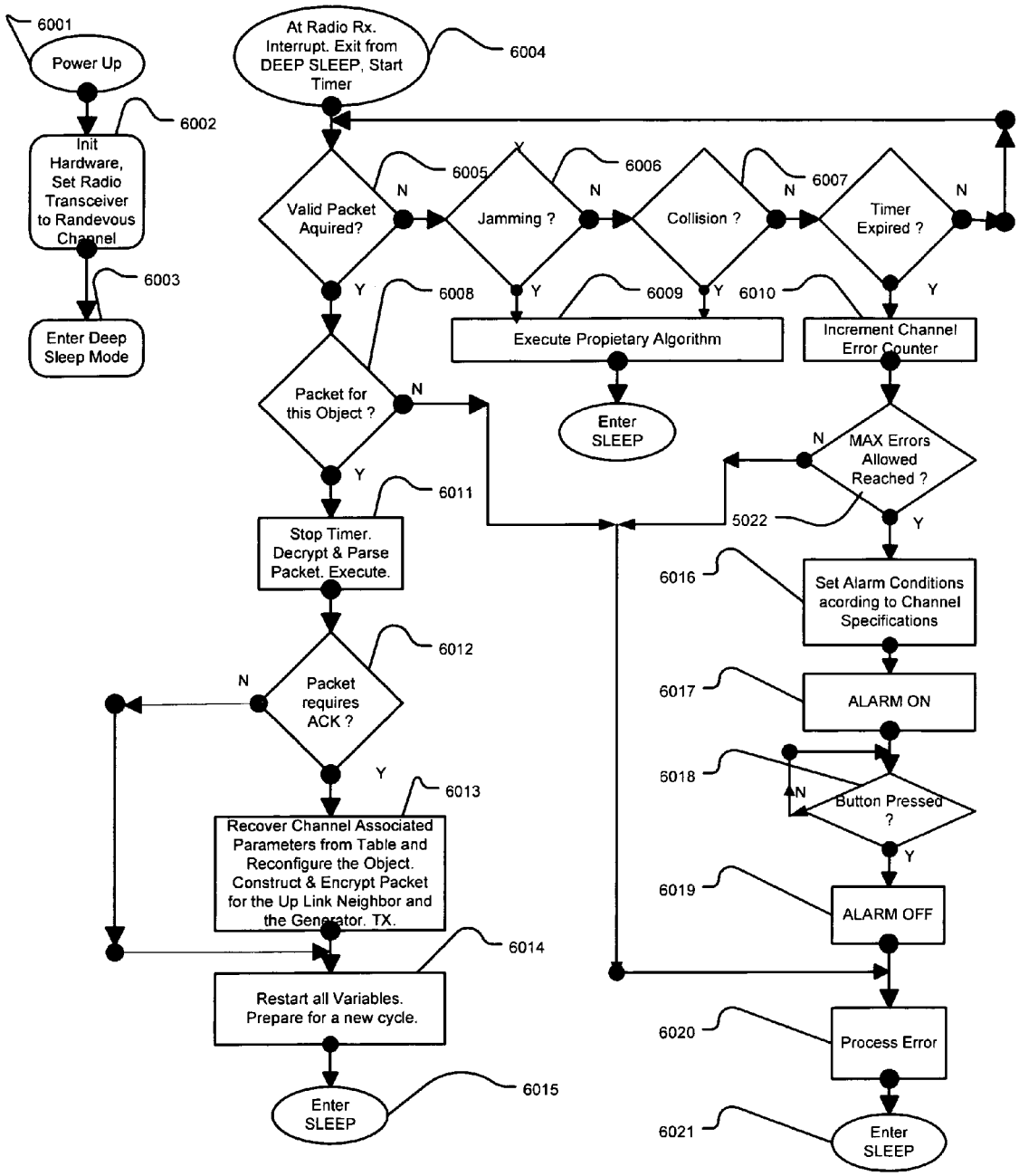
FIG. 6 is the Owner Aware Object Private Space Detector Firmware Flow Chart.
Figure 7:
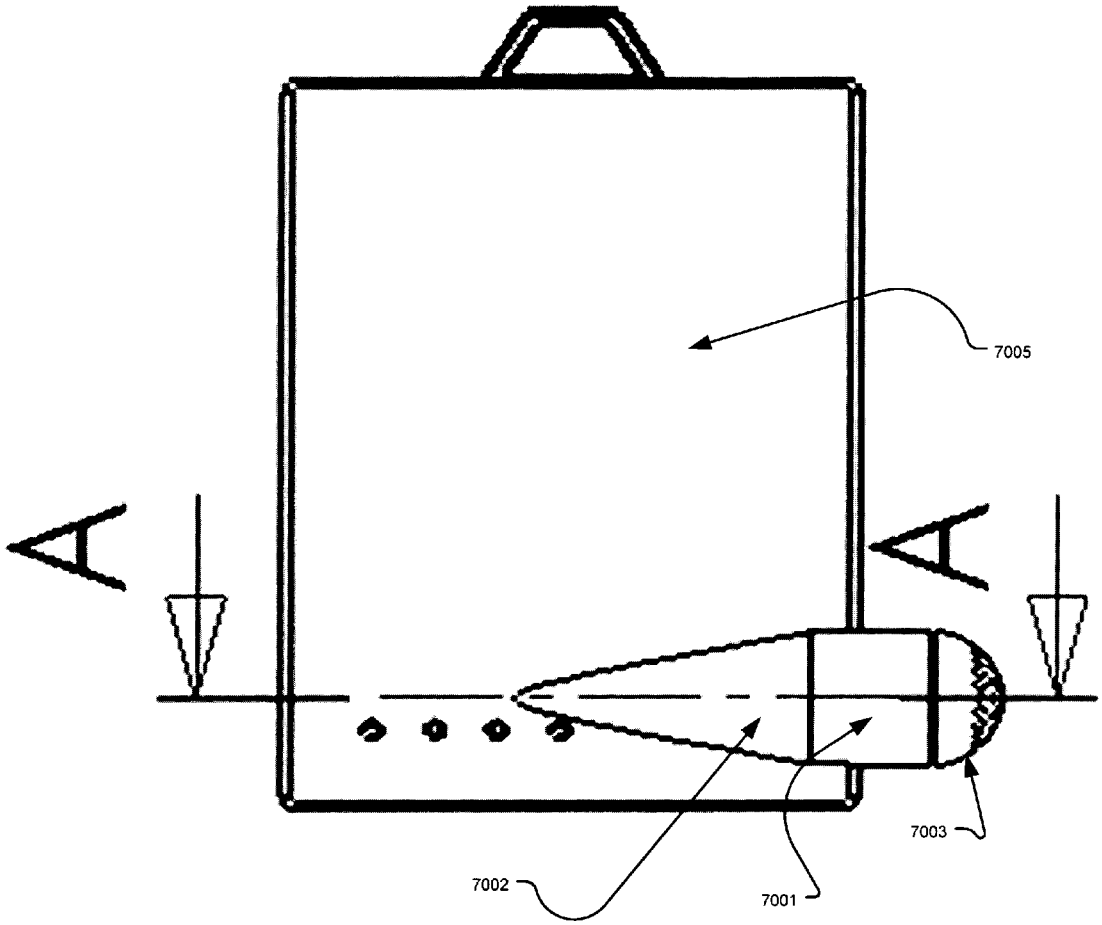
FIG. 7 shows the positioning of the Acoustical Transducer/Speaker and its housing composition.
Figure 7A:
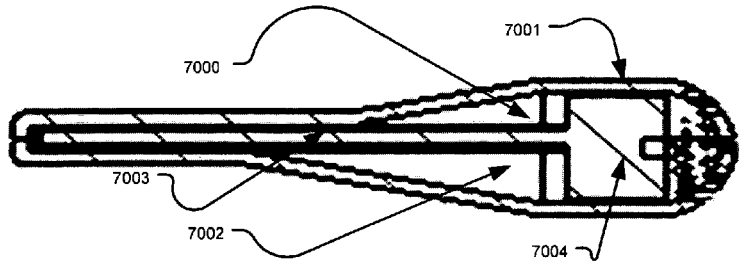
FIG. 7A is a cross section of FIG. 7 long the AA line.
Figure 7B:
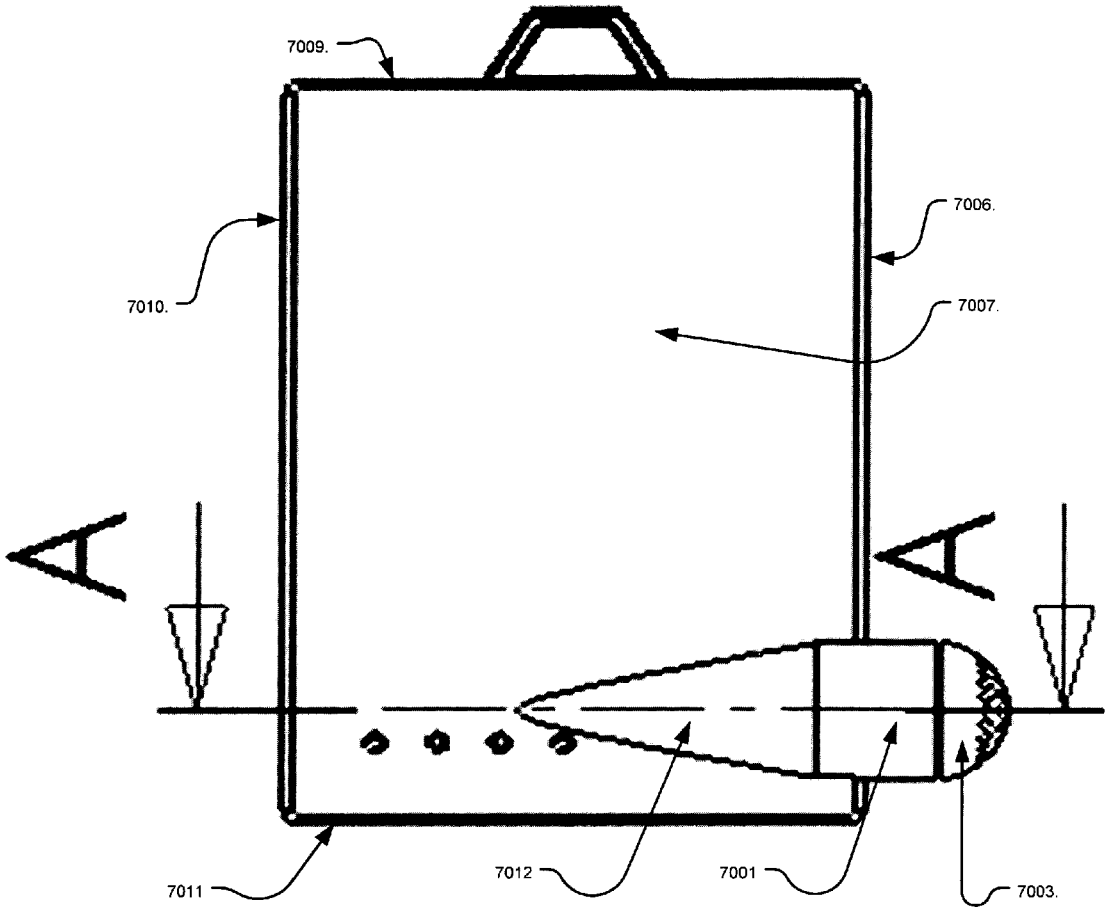
FIG. 7B indicates the positioning of the Acoustical Transducer/Speaker in rapport with the edges of the main body.
Figure 7C:
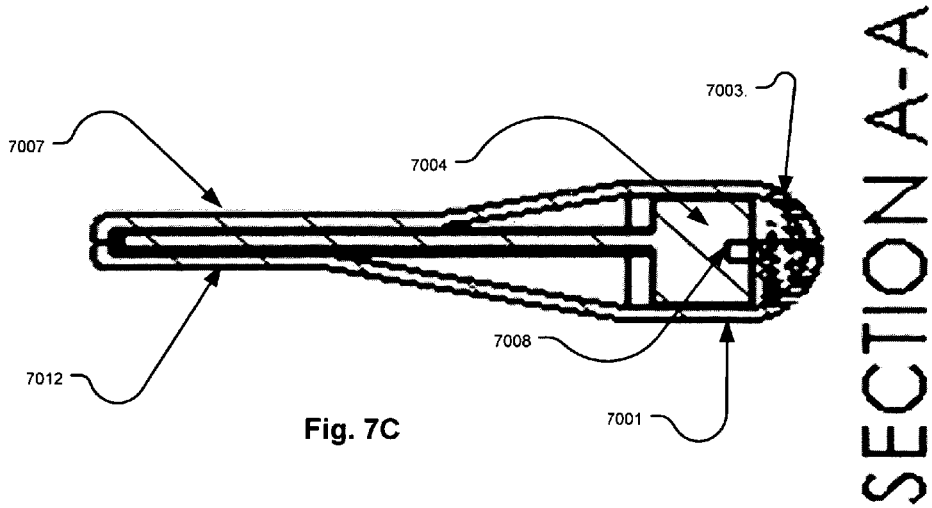
FIG. 7C is a cross section of FIG. 7B along the AA line.
Figure 8:
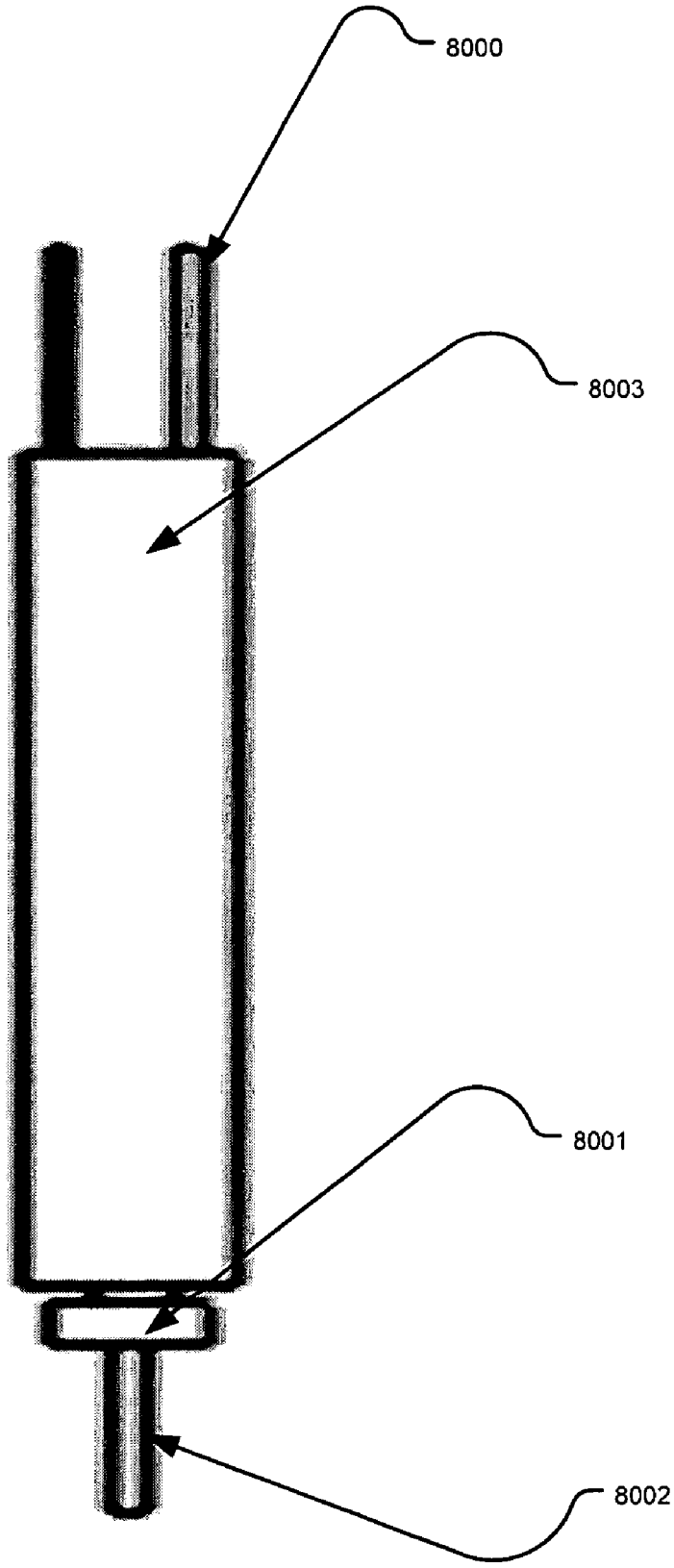
FIG. 8 represents the Olfactive Alarm Sensor High Pressure Gas container and its electromechanical valve with its flexible discharge tube.

What it is claimed is:

1. We claim a multi function Owner Aware Object that mimics the awareness of the presence or absence of its rightful owner and that provides a Safe and Intrusion free three dimensional space for its Owner and his possessions and it is comprised of:

a frequency agile radio transceiver and its antenna that facilitates the creation of an Owner Aware Object Private Three Dimensional Space and the usage of encrypted communications among Owner Aware Objects as every said Owner Aware Object is assigned a private and dynamic range of operating frequencies;

and a Radio Transceiver control circuitry implemented by a highly integrated Microcontroller that is executing a programmed code from its internal Code Space and that provides said Owner Aware Object intelligence and encrypting facilities for said communication messages and also provides a Time Divisions Multiplex and Frequency Division Multiplex control protocol necessary to avoid collisions and jamming, said protocol having;

means of creating a Three Dimensional Owner Aware Object Private Space;

means to operate a modified token ring network protocol in a network in the radiofrequency spectrum;

means of ciphered communication with other Owner Aware Objects by a proprietary network process for the purpose of determining their presence or absence within a three dimensional space volume;

means of self configuring at least one of in pairs or within a Network;

means of automatic self determination of an Identification Code;

means of dropping a disappeared Owner Aware Object Identification Code from the network by automatically reconfiguring the network;

means of sounding dynamically programmed, vocal, visual, tone, tactile and olfactory alarm in any combination when necessary;

means to locally store digital compressed multi lingual voice messages that can be used for alarm purposes or sent through the network to one or multiple remote Owner Aware Objects;

means of at least one of receiving or transmitting and conveying acoustically multi lingual voice messages, paging messages and Morse code messages;

means to be integrated with or made part of a keyless entry system;

means to be integrated with or made part of a RFID system; and means to store critical personal and health data that can be interrogated remotely and wirelessly by at least one of Health Care or Emergency Medical System workers;

means to connect to a computer for the purpose of retrieving event logs, transmitting voice or Morse messages and paging;

means to recharge batteries by a photovoltaic cell array or by a contact-less charger;

means to enhance an acoustical transducer wave output by using a special mounting position and incorporating it into a specially designed acoustical chamber and its critical physical positioning on the edge of the Owner Aware Object.

2. I claim an Owner Aware Object according to claim 1 that fulfills both tasks, this of a monitor and that of a tag in a single physical enclosure that contains hardware circuits and firmware and power sources needed for its operation.

3. I claim an Owner Aware Object according to claim 1 that said programmed code has means to operate a modified token ring network protocol in the radio frequency spectrum.

4. I claim an Owner Aware Object according to claim 3 that will activate a multiple alarm subsystem when its modified token ring network operations are interrupted or otherwise disturbed by fading, jamming, collisions, node disappearance from the network or electronic active eavesdropping.

5. I claim an Owner Aware Object according to claim 1 that is part of a private radio frequency spectrum network that can accommodate a very large number of Owner Aware Objects and in which any Owner Aware Object can relay messages to any other Owner Aware Object.

6. I claim an Owner Aware Object according to claim 1 that increases the operating range of an Owner Aware Object without increasing the radio frequency output power of a transmitter portion nor by increasing a receiver portion sensitivity but by using a mixed Mode of operations which allow owner Aware Objects to relay network messages beyond the physical range of an owner Aware Private Space Generator.

7. I claim an Owner Aware Object according to claim 1 that can be connected to a Computer System/Network and thus facilitating Owner Aware Objects Voice Messaging and Tone and or Voice Paging and Morse Code Text transmission.

8. I claim an Owner Aware Object according to claim 1 that is capable of sounding and transmit through an network canned Voice and Morse messages.

9. I claim an Owner Aware Object according to claim 1 with special Dynamically Programmable Alarm Subsystems comprised of:

A) an Acoustical Transducer/Speaker with a physical mounting that is critical to the performance of Owner Aware Objects and produces a variety of acoustical signals;

where an Acoustical Transducer is mounted within a specially designed Acoustical Chamber that enhances and amplifies the audio wave of said Acoustical Transducer, whereas the Acoustical Transducer and its Acoustical Chamber is mounted on the side and laterally to an enclosure such that it will protrude outside and laterally of an enclosure volume, this protrusion creating a cylindrical chamber that terminates in a slightly conical focusing and perforated dome, whereas behind the cylindrical chamber is an elongated conical section that is tuned to a specific mechanical resonance of a certain acoustical frequency range and the position of the protrusion allows Acoustical Ports of said Acoustical Transducer to remain unobstructed even if the Owner Aware Object is compressed in a small wallet;

and B) a Dynamically Programmable Olfactive type Alarm that contains:

a) a high pressure gas container filled with a highly smelling and volatile gas, b) an electromagnetic valve the can be open or closed under the microcontroller control thus releasing a specific amount of gas in a surrounding environment, c) a flexible ejecting tube that directs the gas outside of the Owner Aware Object enclosure through an opening in the wall of said enclosure, d) a high pressure container that can hold high pressure gas mixed with an identifiable and permanent ink that when it is released will smear/mark permanently objects on which is falling;

and C) a Dynamically Programmable Visual type alarm that will produce a variety of luminescent indication of the state of the alarm;

and D) a Dynamically Programmable tactile type alarm that will produce a variety of vibration sensation to a user.

10. I claim an Owner Aware Object according to claim 3 that reserves a clear communication channel for at least one of configuration or high priority messaging.

11. I claim an Owner Aware Object according to claim 3 that uses a random number generated by the radio transceiver to compute an Identification Code.

* * * * *